United States Patent [19]

Greene

[11] Patent Number: 4,463,035

[45] Date of Patent: Jul. 31, 1984

[54] PROCESS FOR IMPARTING LUBRICITY TO FIBERFILL FIBER

[75] Inventor: George H. Greene, Croton-on-Hudson, N.Y.

[73] Assignee: Union Carbide Corporation, Danbury, Conn.

[21] Appl. No.: 454,335

[22] Filed: Dec. 29, 1982

[51] Int. Cl.[3] ..... B05D 3/02

[52] U.S. Cl. ..... 427/389.9; 252/8.6; 252/8.9; 427/393.4; 427/393.1

[58] Field of Search ..... 427/389.9, 393.4, 393.1; 252/8.6, 8.9

[56] References Cited

U.S. PATENT DOCUMENTS 3,213,053 10/1965 Kendrick ..... 260/29.6

FOREIGN PATENT DOCUMENTS 1427787 6/1971 France .

513282 6/1971 Switzerland .

*Primary Examiner*—Thurman K. Page

*Attorney, Agent, or Firm*—Jean B. Mauro

[57] ABSTRACT

A process for imparting lubricity to fibers which comprises applying a graft copolymer of an N-(oxymethyl)-acrylamide and a poly(oxyalkylene) to the surface of the fiber and crosslinking the graft copolymer on the surface of the fiber.

14 Claims, No Drawings

PROCESS FOR IMPARTING LUBRICITY TO FIBERFILL FIBER

TECHNICAL FIELD

This invention pertains to the art of applying polymeric finishes to textile fibers.

BACKGROUND OF THE INVENTION

Unfinished polyester fiberfill fibers exhibit fiber scroop and a rough hand due to high interfiber friction. It is known in the art that an silicone finish will lower interfiber friction and thereby make polyester fiberfill fibers acceptable for commercial uses where fiber scroop can be a problem. For example, Dacron Hollofil II available from E. I. duPont de Nemours is finished with a silicone which lowers the interfiber friction associated with fiberfill fibers and thereby imparts a soft, down-like, hand. However, silicone finishes adversely affect the flammability and latex bondability of polyester fiberfill fibers.

It is also known in the art of fabric finishing that a crosslinkable organic polymer, when applied to a synthetic fabric, will reduce the static electricity associated with such fabrics. For example, U.S. Pat. No. 3,213,053 to Kendrick discloses that an antistatic composition of a crosslinkable terpolymer of: (1) 5% to 10% of glycidyl methacrylate; (2) 35% to 55% of an alkali metal salt of a styrene sulfonate; and (3) 35% to 60% of methoxypoly(ethylene glycol) methacrylate wherein the poly(ethylene glycol) chain has a molecular weight from 250 to 500, will reduce the static electricity of a synthetic fabric when applied as a finish. Likewise, French Pat. No. 1,427,787 discloses that a copolymer of: (1) from 2% to 20% of an ethylenically unsaturated epoxide or a corresponding methylol compound; with (2) from 98% to 80% of an ester of an ethylenically unsaturated carboxylic acid and an alkylphenoxy polyethylene glycol, will reduce the static electricity or synthetic fabrics when applied to said fabrics as a fabric finish. Similarly, Swiss Pat. No. 513,282 discloses that a copolymer composed of: (1) from 80% to 90% of an ester of an alkyl polyethylene glycol having an alkyl residue with 1 to 3 carbon atoms and an average molecular weight of from 300 to 1000 and an ethylenically unsaturated polmerizable carboxylic acid; (2) 5% to 10% of a etherified N-methylolamide of an ethylenically unsaturated polymerizable carboxylic acid; and (3) 5% to 10% of an ethylenically unsaturated polymerizable compound containing at least one acid group capable of imparting solubility in water, e.g. acrylic acid; will reduce the static electricity associated with a synthetic fabric and enhance the soil release properties of such a fabric.

SUMMARY OF THE INVENTION

In accordance with the present invention, it has been found that the process which comprises (a) treating fibers with a neat composition, solution or dispersion containing:

(i) from about 0.1% to about 5% by solution weight or neat composition weight of an acid catalyst, and (ii) at least about 0.001% by solution weight or neat composition weight of a graft copolymer prepared by grafting to a poly(oxyalkylene) from about 0.5% to about 50% by graft copolymer weight of an N-(oxymethyl)-acrylamide having the formula:

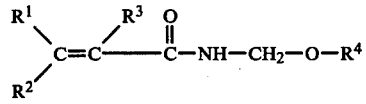

wherein $R^1$, $R^2$, $R^3$, and $R^4$ are hydrogen or monovalent hydrocarbon radicals containing from 1 to about 6 carbon atoms each and may be the same or different and a poly(oxyalkylene) of the formula:

$$R^5[(OC_nH_{2n})_zXR^6]_a$$

wherein $R^5$ is a hydrocarbon radical having a valence of a and containing up to about 21 carbon atoms, a is an integer having values between 1 and 4, X is an oxygen, nitrogen or sulfur atom, $R^6$ is a hydrogen atom or hydrocarbon radical containing up to about 6 carbon atoms and may contain hydroxyl, amino or mercaptyl groups, n is an integer from 2 to 4 and z is an integer having a value from about 2 to about 800, and (b) drying and curing said treated fiber at between about 100° C. and about 170° C., imparts to the fiber a durable finish which increases the lubricity of the fiber manifested by a lowering of interfiber friction without adversely affecting the flammability or the latex bondability of the fiber.

The graft copolymers useful in the present invention may be prepared as described in copending application Ser. No. 307,211 filed Sept. 30, 1981.

DETAILS OF THE INVENTION

Graft copolymers useful in the present invention having an N-(oxymethyl) acrylamide grafted onto a poly(oxyalkylene) compound are prepared by a method which comprises adding an N-(oxymethyl) derivative of acrylamide monomer as hereinafter more fully described and a suitable catalyst to an agitated bath of the poly(oxyalkylene), whereby all of said components are intimately admixed at a temperature at which reaction occurs, and maintaining said temperature until said graft copolymer of acrylamide derivative on poly(alkylene oxide) is obtained.

The poly(oxyalkylene) compounds used to make. the graft copolymers of the invention are known in the art and have the formula:

$$R^5[(OC_nH_{2n})_zXR^6]_a$$

wherein $R^5$ is a hydrocarbon radical containing up to 10 carbon atoms and has a valence of a, a is an interger having a value of 1 to 4, $R^6$ is a hydrogen atom or a monovalent hydrocarbon radical containing up to 6 carbon atoms and may contain hydroxyl (—OH) amino (—$MH_2$) or mercaptyl (—$SH_2$) groups. X is an oxygen, nitrogen or sulfur atom, n is an integer from 2 to 4, and z is an integer having a value of about 2 to about 800.

In general, these compounds contain oxyethylene, oxypropylene, oxybutylene groups or both oxyethylene groups and higher oxyalkylene groups such as oxypropylene and oxybutylene groups, either in random or block distribution in their molecules, and have molecular weights (number average) in the range of about 100 to about 35,000, and, preferably, in the range of about 1,500 to 4,000. These poly(oxyalkylene) compounds may be made by processes well known in the art by reacting an alkylene oxide or mixtures of alkylene oxides with an aliphatic compound which may be saturated or contain some aliphatic unsaturation, having from one up to as many as four active hydrogen atoms, such as water, monohydroxylic alcohols such as ethanol, propanol, and allyl alcohol; dihydroxylic alcohols such as ethylene glycol and monoethylether of glycerine; trihydroxylic alcohols such as glycerine and trimethylolpropane; and tetrahydroxylic alcohols such as sorbitol. Especially preferred active hydrogen compounds are allyl alcohol and glycerine. The poly(oxyalkylene) products of such reactions will have linear or branched oxyalkylene or mixed oxyalkylene chains, and such chains will terminate with hydroxyl groups. Although the preferred poly(oxyalkylenes) are hydroxyl terminated, some or all of these hydroxyl groups may be etherified by reaction with a dialkyl sulfate such as diethyl sulfate. These terminal hydroxyl groups may also be etherified with alkyl-halohydrins such as 2-chloro ethanol. This will yield a poly(oxyalkylene) that has a terminal hydroxyl group which is preferred because of its ability to condense with the N-(oxymethyl) functionality that is introduced into the poly(oxyalkylene) to facilitate crosslinking of the poly(oxyalkylene) chains.

The grafting monomers employed in preparing the copolymers useful in the present invention are substituted acrylamide monomers having the formula

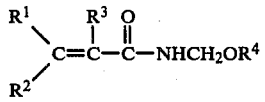

wherein $R^1$, $R^2$, $R^3$ and $R^4$ may be the same or different and are hydrogen atoms or a monovalent hydrocarbon radicals containing from 1 to about 6 carbon atoms. These acrylamide derivative monomers are generally homopolymerizable monomers with a reactive cross linkable pendent group or groups. Illustrative suitable monomers are methoxymethyl acrylamide, ethyoxymethyl acrylamide, N-butoxymethyl acrylamide, allyloxymethyl acrylamide, N-butoxymetharylamide and preferably, N-methylolacrylamide and N-(iso-butoxymethyl)-acrylamide.

A catalyst is employed in the process of the invention which is a free radical initiator. The choice of such initiator is important because it should be active at a temperature below 160° C. but any one of a wide variety of known inorganic or organic free radical initiators may be used. The choice of initiator will generally depend on the particular combination of reactants from which the graft copolymer will be prepared. Exemplary of suitable initiators are azobisisobutyronitrile; hydroperoxides such as t-butyl peroxypivalate, di-t-butyl peroxide, and t-butyl perbenzoate; peroxycarbonates such as diethyl peroxydicarbonate and diisopropyl peroxycarbonate; and persulfates such as potassium and sodium persulfates.

Homogeneous graft copolymers useful in the present invention which are substantially free (contain less than 2 percent by weight) of insoluble homopolymerized acrylamide derivative may be prepared by methods known in the art but preferably are prepared by charging the reactants in two separate feed streams, advantageously in gradual and/or incremental amounts, one of which consists of the grafting monomer and a second consisting of the free radical grafting initiator. Either of the reactants may be mixed with a portion of the poly(oxyalkylene) compound prior to feeding them to the reaction zone when doing so facilitates the gradual or incremental feeding thereof to the reaction mixture. The amount of acrylamide derivative added to the polymerization reactor zone is not critical and may be varied over a wide range. The preferred range is from about 6% to about 12% by weight of poly(oxyalkylene). In general, however, up to about 70 percent by weight, and preferably from about 0.5 percent by weight to about 50 percent by weight based on the total weight of poly(alkylene oxide) compound, is charged.

The temperatures at which the graft reaction may be carried out may vary over a wide range and depend, in general, upon the combination of reactants to be used in the reaction. For example, when organic free radical grafting initiators are employed, a temperature sufficient to activate the initiator to about 160° C. can be used in the grafting reacting, and preferably, a temperature in the range from about 70° C. to about 100° C. Where employing inorganic free radical initiators, a temperature from about above the freezing point of the solvent to about 65° C. may be employed. Reaction temperatures above 160° C. lead to gelling of the reaction mixture, and should be avoided.

Incremental and/or gradual addition of the two separate reactant feed streams coupled with efficient agitation of the poly(oxyalkylene) compound in the reaction zone constitutes the most important technique for producing the graft copolymers useful in the present invention. This method is particularly important in large scale or commercial operations, not only for preparing the desired homogenous graft compolymer, but also to facilitate handling and storage of the monomer and the free radical initiator.

The grafting reaction is preferably carried out in bulk without the use of a solvent. If desired, however, a solvent may be used which is inert to the reactants. Suitable solvents include benzene, toluene, tertiary-butylbenzene, heptane, hexane, or octane, and mixtures thereof, and water.

The preferred graft copolymers are made from a poly(oxyethylene-co-oxypropylene) copolymer of molecular weight in the range of 350 g/mol to 4000 g/mol and which are at least 40% ethylene oxide monomer by weight of the polymer. The upper limit is not critical as longer chain polymers have been found to impart better lubricity, however; the high viscosity of a very high molecular weight poly(oxyalkylenes) may make the use of such polymers difficult. The preferred poly(oxyalkylenes) have been treated with a sufficient amount of N-methylol-acrylamide or N-(isobutoxymethyl)-acrylamide in a grafting reaction such that at least an average of 1½ N-(oxymethyl)-acrylamides molecules are grafted onto each poly(oxyalkylene) molecule and most preferably an average of from 3 to 6 N-(oxymethyl)-acrylamide molecules per poly(oxyalkylene) molecule.

An optional component of the fiber treating solution is an antioxidant that will inhibit the degradation of the poly(oxyalkylene) polymer thereby improving the durability of the "fiber finish." Such antioxidants are well known in the art of stabilizing poly(oxyalkylenes) and may include any number of antioxidant compounds. Especially suitable are hindered phenolic compounds such as Bisphenol A, BHA and BHT. The amount of such an antioxidant is not critical and generally ranges from about 1% to about 3% by weight of the treating composition or solution.

The graft copolymer is then mixed with an acid catalyst and applied to the fiber to be treated.

Although the examples given herein are directed to the practice of the instant invention with fiberfill fibers, it is believed that the instant invention will impart lubricity to any synthetic fiber, e.g. a textile fiber. It is to be understood that the phrase fiberfill fiber is intended to mean any non-woven bating or fiber mat. Although all the examples shown herein are limited to carded polyester fibers it is believed that non-carded, non-polyester fibers will exhibit similar properties when treated by the process of the instant invention. In addition to the Hollofil-808 fibers available from E. I. duPont de Nemours that are exemplified herein, other fiberfill fibers such as the round, solid fiber available from Hoechst are useful in the instant invention.

The choice of acid catalyst suitable for use in the invention is not critical and may depend on economic or toxicological factors. Any acid that will lower the pH sufficiently to make the solution weakly acidic will catalyze the crosslinking of the graft copolymer on the fabric surface. Examples of acid catalysts include inorganic acids such as hydrochloric, hydrobromic, sulfuric and nitric acids; organic acids such as carboxylic acids, phenols, aklyl and aryl sulfonic acids and the like. Lewis acids such as zinc fluoroborate and the like will also catalyze the graft copolymer cross-linking on the surface of the fabric. An acid catalyst that is particularly suitable for use in the instant invention is citric acid because of its commercial availability and non-toxicity. In a most preferred embodiment, the acid catalyst chosen is water soluble because an aqueous solution is a convenient medium with which to apply the graft copolymer to the fiber.

The graft copolymer and acid catalyst may be applied as a neat composition or a solution. Any solvent which will dissolve the graft copolymer may be used. Suitable solvents include water, alcohols, ketones, esters or mixtures thereof that will dissolve the graft copolymer and the acid catalyst. When water is used as the solvent, a functional additive such as an anionic or nonionic surfactant may be added to facilitate the initial wetting of the fiber. In a most preferred embodiment, the graft copolymer and acid catalyst are added to water to form a treatment solution that is from ½% to 15% by solution weight of graft copolymer and 0.001% to 2% by solution weight of an acid catalyst.

The solution may be applied in any manner that is effective to wet the fiber with the solution. If the fiber is deposited in a bath containing the treatment solution, the residence time in the bath need only be so long as to allow the fabric to be substantially wetted by the solution. The addition of wetting agents such as surfactants will reduce the necessary residence time. The temperature of the treatment solution is not critical so long as it is maintained below the temperature that will cross-link the graft copolymer in solution with the acid catalyst. The treated fiber is then heated at a temperature and for a period of time sufficient to dry the fiber and cure the graft copolymer on the fiber surface. Generally, a few minutes in an oven at between 100° C. and 170° C. is sufficient, but the actual time and temperature necessary will depend primarily upon the catalyst and solvent chosen.

The dried, treated fiber is then ready for further processing with the graft copolymer cross-linked on the surface of the fiber as a durable, lubricating fiber finish. Any residual acid catalyst may be removed by further processing which may include a simple rinsing procedure.

This invention is further described in the Examples which follow. These examples are intended to be illustrative of specific embodiments of this invention and are not intended in any way to limit the scope of the invention. All parts and percentages are by weight unless otherwise specified.

EXAMPLES 1 & 2

Graft Copolymer Preparation

Example 1

A four-neck round-bottom glass flask, fitted with a mechanical stirrer, thermometer, water condenser with nitrogen source, two 250 inch dropping funnels and nitrogen outlet, was charged with 184.3 gm of an allyl-started ethylene oxide/propylene oxide copolymer (40/60 by weight) having a viscosity of 450 SUS (Seconds, Universal Saybolt). One dropping funnel was charged with 64.3 gm of N-(isobutoxymethyl)-acrylamide (IBMA) and the other was charged with 20.3 gm of ethyl acetate and 1.3 gm of 2,2-azobis-(2-methylpropionitrile). The flask contents were heated to 80° with an electrical heating mantle and the flask was purged with dry nitrogen. The IBMA and ethylacetate 2,2-azobis-(2-methylpropionitrile) were added simultaneously and dropwise over a period of one hour at a rate which kept the reaction mixture between 80° and 83° C. After addition of the IBMA and ethyl acetate/2,2-azobis (2-methylpropionitrile) was completed, the flask and its contents were heated to 80° C. for three additional hours and then allowed to cool to room temperature. Any remaining unreacted IBMA was removed by vacuum stripping along with the ethyl acetate used to introduce the acid catalyst. The graft copolymer obtained thereby is a clear, pourable liquid that is added to water to make the fabric treating solution or may be applied to the fabric as a neat composition with the acid catalyst.

Example 2

A 250 ml three neck round bottom flask equipped with a stirrer was used in this example. To this reactor was charged 120 grams of distilled water, 0.5 grams of sodium bicarbonate, 0.5 grams of sodium sulfite and 0.5 grams of sodium persulfate. After dissolution of the salts was completed by stirring, 15.3 grams (0.0059 moles) of the poly(oxyalkylene) polymer used in Example 2 were added and the resulting solution was cooled to 0° to 5° C. A 48 percent aqueous solution of N-methylolacrylamide containing 7.4 grams (0.034 moles) (28.6 weight percent of the total charge) with 5.0 grams additional water was added dropwise to the reaction mixture over a period of 15 minutes. After addition of all reactants was completed, the reaction mixture was stirred for an additional 45 minutes while maintaining the temperature at 0° to 5° C., and then the reaction mixture was allowed to warm to room temperature.

This crude reaction mixture may then be diluted to form a treating solution upon the addition of a solvent and a suitable acid catalyst.

Finish Application and Lubricity Testing

The samples tested in the following examples were prepared by padding the aqueous finishing composition onto carded Hollofil-808, a round, hollow, polyester fiberfill fiber available from E. I. duPont de Nemours. The amount of finish taken up was controlled such that the Hollofil-808 takes up its own weight in aqueous finish. This 100% pick-up of finish on the fiberfill translated into a percent by weight of finish on the fiberfill equal to the percent by weight of finish in solution, i.e. a 1% graft copolymer finishing solution yielded a finished Hollofil-808 sample that is 1% by weight of graft copolymer finish.

The finished fibers were then dried at the temperature indicated and for the time indicated in the following examples.

The treated samples were then allowed to condition for three days by maintaining them in a constant environment of 50% relative humidity and 70° F. The samples were then tested for lubricity according to a "Staple Pad Friction" technique. In this technique, a weighted sled is pulled across a fiber sample by an Instron Model 1000 available from Instron Corp., Canton, Mass. The "Staple Pad Friction" is displayed in grams by the Instron and the Staple Pad Friction (hereinafter referred to as SPF) Index is computed by dividing the Staple Pad Friction in grams by the sled weight in grams.

To test the durability of the graft copolymer finish, the samples as indicated were washed for 10 min. in a solution of 2.25 g of AATCC Detergent #124 held at 70° C. The samples were then rinsed with deionized water at room temperature and were allowed to recondition in a constant environment as hereinbefore described.

Example 3

This is a control for Examples 4–6 in which untreated Hollofil-808 exhibited an SPF of 0.40. The results of Examples 3–6 are tabulated in Table I.

Example 4

This is a comparative example in which a 1% solution of a ungrafted allyl-started ethylene oxide/propylene oxide (40/60 by weight) with a viscosity of 2700 SUS (Seconds, Universal, Saybolt) and an average molecular weight of 3700 g/mol was padded onto a carded Hollofil-808 sample as hereinafter described and tested as herein before described. The SPF for such an ungrafted sample was 0.36 before washing.

Example 5

This is a comparative example wherein no catalyst was used to cure the graft copolymer. The procedure of Example 4 was followed with the exception that the graft copolymer was composed of 26.6 g by weight of N-(isobutoxymethyl)-acrylamide grafted onto an allyl-started ethylene oxide/propylene oxide (40/60 by weight) with a viscosity of 450 SUS and an average molecular weight of 1400 g/mol. No catalyst was, however, added to the finishing solution. The treated Hollofil-808 fiber exhibited an SPF of 0.30 before washing and an SPF of 0.39 after washing.

Example 6

This is a preferred example wherein 7.5 g of a graft copolymer composed of 12% by weight of polymer of N-(isobutoxymethyl)-acrylamide grafted onto the poly(oxyalkylene) of Example 4, 7.5 g of citric acid and 0.15 g of Bisphenol A were dissolved in enough deionized water to form a 750 g of finishing solution. Samples of Hollofil-808 were treated and tested as hereinbefore described to yield an SPF Index of 0.27 after curing for 10 min. at 150° C. but before washing, and an SPF of 0.29 after washing as hereinbefore described.

Example 7

This is a preferred example wherein 7.4 g of a graft copolymer composed of 12% N-(isobutoxymethyl)-acrylamide grafted onto a glycerol-started ethylene oxide/propylene oxide (14/86 by weight) with a viscosity of 360 SUS and an average molecular weight of 4741 g/mol was dispersed in 750 g of finishing to which was also added 0.75 g of ethoxylated nonyl-phenol, Tergitol NP-40 available from Union Carbide Corporation (as a surfactant to disperse the nearly insoluble graft copolymer), 7.5 g of citric acid and 0.15 g of Bisohenol A. The procedure of application and testing of Example 5 then yield an SPF before washing of 0.26 and an SPF after washing of 0.29.

TABLE I

| Example | EO/PO Copolymer | Catalyst | SPF Before Washing | SPF After Washing |
|---|---|---|---|---|
| 3 | None | None | .40 | .48 |
| 4 | None | None | .41 | .44 |
| 5 | EO/PO-2700 SUS* | None | .36 | — |
| 6 | EO/PO-450 SUS* 26.6% IBMA | None | .30 | .39 |
| 7 | EO/PO-2700 SUS* 12% IBMA | Citric Acid | .27 | .29 |
| 8 | EO/PO-360 SUS* 12% IBMA | Citric Acid | .26 | .29 |

*As more fully described in the corresponding Example

Table I illustrates that a durable fiberfill finish is obtained by the practice of the present invention which significantly lowers the interfiber friction associated with polyester fiberfill fibers.

I claim:

1. A process to impart lubricity to fibers which comprises:

(a) treating said fibers with a neat composition, solution or dispersion containing:

(i) from about 0.001% to about 2% by solution weight or neat composition weight of an acid catalyst, (ii) at least about 0.5% by solution weight or neat composition weight of a graft copolymer prepared by grafting to a poly(oxyalkylene) from about 0.5% to about 50% by polymer weight of an N-(oxymethyl) acrylamide of the formula:

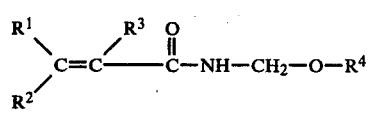

wherein one or more $R^1$, $R^2$, $R^3$, and $R^4$ are hydrogen or monovalent hydrocarbon radicals containing from 1 to about 6 carbon atoms each and the poly(oxyalkylene) is of the formula:

$$R^5[(OC_nH_{2n})_zXR^6]_a$$

wherein $R^5$ is a hydrocarbon radical having a valence of a and containing up to about 21 carbon atoms, a is an integers having values between 1 and 4, X is an oxygen, nitrogen or sulfur atom, $R^6$ is a hydrogen atom or hydrocarbon radical containing up to about 6 carbon atoms and may contain hydroxyl, amino or mercaptyl groups, n is an integer from 2 to 4 and z is an integer having a value from about 2 to about 800, and (b) drying and curing said treated fiber.

2. The process of claim 1 wherein said substituted N-methylol derivative of acrylamide is N-(isobutoxymethyl) acrylamide.

3. The process of claim 1 wherein said poly(oxyalkylene) is made by reacting an alkylene oxide, or mixtures thereof, with an aliphatic compound which is saturated or contains aliphatic unsaturation and which contains from one to four active hydrogen atoms.

4. The process of claim 1 wherein the poly(oxyalkylene) is poly(oxyethylene), poly(oxypropylene) or mixtures or copolymers thereof.

5. The process of claim 1 wherein the poly(oxyalkylene) is poly(oxyethylene-co-coxypropylene) monoallyl ether, containing 40 percent oxyethylene/60 percent oxypropylene.

6. The process of claim 1 wherein the acid catalyst is citric acid.

7. The process of claim 1 wherein the acid catalyst is acetic acid.

8. The process of claim 1 wherein the curing temperature is about 140° C.

9. The process of claim 1 wherein the hydrocarbon radical $R^5$ is selected from the group of allyl, butyl, and glyceryl radicals.

10. The process of claim 1 wherein $R^6$ is a hydrogen atom.

11. The process of claim 1 wherein z is between about 40 and about 135.

12. The process of claim 1 wherein bis-phenol is added to the treatment solution.

13. The process of claim 1 wherein the fiber is cured at a temperature between 100° C. and 170° C.

14. The process of claim 1 wherein the fiber treated is a fiberfill fiber.

* * * * *